US006543728B1

(12) United States Patent
Benenowski et al.

(10) Patent No.: US 6,543,728 B1
(45) Date of Patent: Apr. 8, 2003

(54) CROSS FROG

(75) Inventors: Sebastian Benenowski, Butzbach (DE); Alfred Kais, Lich-Eberstadt (DE); Stefan Schmedders, Butzbach (DE)

(73) Assignee: BWG GmbH & Co. KG, Butzbach (DE)

( * ) Notice: Subject to any disclaimer, the term of this patent is extended or adjusted under 35 U.S.C. 154(b) by 0 days.

(21) Appl. No.: 09/926,597

(22) PCT Filed: May 26, 2000

(86) PCT No.: PCT/EP00/04820

§ 371 (c)(1),
(2), (4) Date: Jan. 7, 2002

(87) PCT Pub. No.: WO00/073586

PCT Pub. Date: Dec. 7, 2000

(30) Foreign Application Priority Data

May 28, 1999 (DE) ..... 199 24 463

(51) Int. Cl.[7] ..... E01B 7/00
(52) U.S. Cl. ..... 246/472; 246/454; 246/468
(58) Field of Search ..... 246/454, 458, 246/465, 468, 472, 469, 382, 415 R, 427, 464

(56) References Cited

U.S. PATENT DOCUMENTS 26,933 A * 1/1860 Shedd ..... 246/458
30,940 A * 12/1860 Tunner ..... 246/468
90,803 A * 6/1869 Yantis ..... 246/458
1,660,694 A * 2/1928 Volk ..... 246/427
2,611,077 A * 9/1952 Roecker ..... 246/382
4,925,135 A 5/1990 Ziethen et al.

FOREIGN PATENT DOCUMENTS

| | | |
|---|---|---|
| DE | 638307 | 11/1936 |
| DE | 4224159 | 1/1994 |
| EP | 0281880 | 9/1988 |

* cited by examiner

*Primary Examiner*—Mark T. Le
(74) *Attorney, Agent, or Firm*—Dennison, Schultz & Dougherty

(57) ABSTRACT

The invention relates to a cross frog (10) for points and crossings, comprising a cross frog tip (14) and wing rails (16, 18) and running rails (20, 22) situated either side of this point, each with a basic course (38) aligned with a main or secondary track (26, 28). The aim of the invention is to reduce the wear around the cross frog tip without reconstructing the cross frog tip itself or the guard rails allocated thereto or realigning them in relation to each other. To this end, at least one of the running rails deviates from its basic course in the area of the cross frog tip, in such a way that the movement of a rail vehicle running through the main or secondary track is influenced through its wheel frame or bogie axle, away from the cross frog tip.

13 Claims, 3 Drawing Sheets

CROSS FROG

Figure 1:
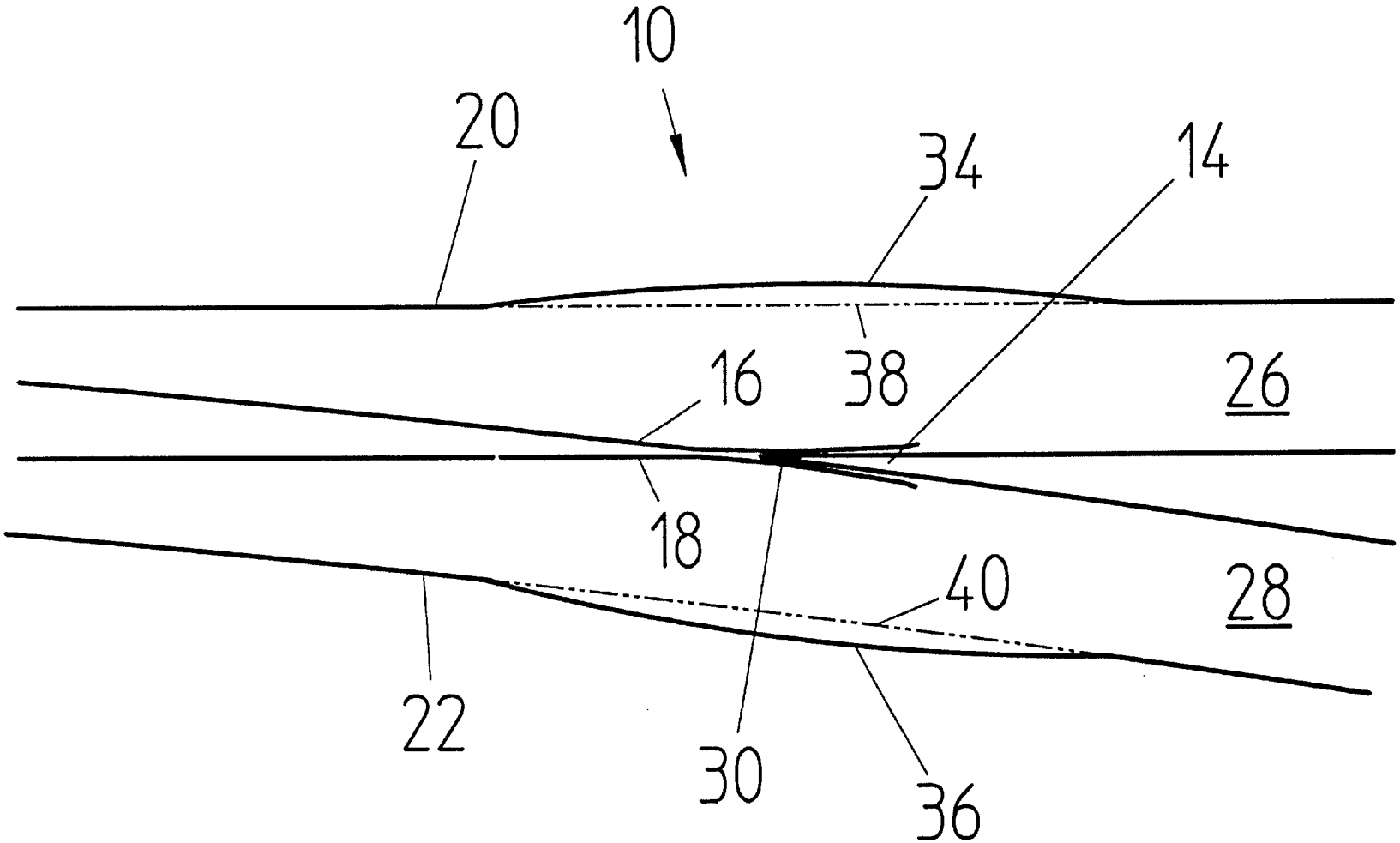

The present invention relates to a cross frog for switches and crossings, including a cross frog tip and, extending at both sides thereof, wing rails and running rails having a basic shape aligned with a main or branch track.

In the field of rigid cross frogs, guide rails give rise to guidance problems, since a flange, in the vicinity of a cross frog gap, which is inevitably caused by intersecting flange grooves, cannot guide the wheel on the head of a rail. Depending on the width of the flange grooves, the axle, and thus the bogie of a vehicle, is joltingly deflected sideways by the guide rail. For trains which travel through a cross frog zone at a speed of e.g. 160 km/h, this deflection occurs in hundredths of seconds. These jolts, on one hand, reduce travel comfort, and on the other hand cause undesirable wear.

Due to constructional requirements, cross frog tips are formed extremely narrowly at their front zones, so that when they are encountered by a wheel, they are subjected to increased wear. This occurs to an extreme extent when the flange of a wheel, at the front zone of the cross frog tip, slides along the cross frog tip.

To avoid or reduce the running on the cross frog tips, according to EP 0 282 796 B1, there is an intentional extension of the transfer zone between the wing rails and the cross frog tip in order to avoid a sudden transfer of force at a point or a very narrow zone from the wing rails to the cross frog tip.

According to DE 42 24 159 A1, the guide rail and the cross frog are intended to extend as a unit from a common base, which is resiliently supported on a sleeper by an intermediate support having spring properties. In this way, on one hand, a preservation of the cross frog tip occurs and, on the other hand, an impact-like co-operation of the wheel and the guide rail is avoided.

Movable cross frog tips are also known, by which it is likewise be attempted to eliminate jolting encounters with the cross frog tip or a grinding of the flange along the cross frog tip.

The present invention is based on the problem of developing a cross frog of the first-mentioned type in such a way that a reduction of wear of the cross frog tip zone occurs without reconstruction of the cross frog tip itself or of the associated guide rail, or of their orientation relative to one another, being required.

According to the invention, the problem is solved, substantially, in that at least one of the running rails, particularly both running rails, deviates in the zone of the cross frog tip from its basic shape in such a way that the wheel- or bogie axle of a railroad vehicle travelling along the main or branch track experiences an effect of a movement directed away from the cross frog tip.

By the change of shape, the wheel rolling at the running rail side undergoes a change of its point of support such that the wheel- or bogie axle is forcibly aligned relative to the main or branch track so that the normal thereof extends parallel to or approximately parallel to the respective longitudinal axis of the track being travelled, with the consequence that the grinding or sliding movement of the wheel flange along the flank of the cross frog tip, which would otherwise cause wear, does not occur.

It is in particular intended that the change of shape of the running rail is so formed that a wheel travelling along the running rail is held to a running circle of radius $r_1$, which is smaller than a running circle $r_2$ to which the wheel rolling on the cross frog tip is held. The radii $r_1$ and $r_2$ are thereby related substantially as $r_1:r_2 \approx 0.91:1$ to $r_1:r_2 \approx 0.98:1$.

Differing from the above-mentioned state of the art, in the zone of the cross frog tip no new reconstruction of the cross frog tip itself or of the arrangement of the cross frog tip with respect to the guide rail occurs, but the running rails associated with the cross frog tip are so changed in shape that an intentional influence on the point of support of the wheel rolling on the running rail is produced, with the consequence that the wheel flange of the wheel rolling on the cross frog tip is held away from the flanks of the cross frog tip.

In particular, it is intended that the running rail, in the zone of the cross frog tip, with respect to its line of contact formed by the prevailing points of support of the wheel, runs curved away from the cross frog tip, and thus exhibits a concave shape with respect to the cross frog tip.

The line of contact between the wheel and the head of the running rail, deviating from the basic shape, can be obtained by the running rail head or the running surface thereof, in the zone of the cross frog tip, being more inclined relative to the cross frog tip, in comparison to the basic shape of the running rail. In that connection, the running rail or its running surface in the zone of the cross frog tip can be more strongly inclined to the cross frog tip, through an angle $\alpha$, than the running rail in the basic shape, where $1.5° < \alpha < 5°$, and especially $\alpha \approx 3°$.

An optimum preservation of the cross frog tip is obtained when the change of shape of the running rail begins at a distance x before the cross frog tip, where 15,000–20,000 mm>x>5000 mm. Furthermore, the change of shape should terminate at a distance y beyond the cross frog tip, where 18,000–23,000 mm>y>8000 mm. The beginning and end, for the main and branch tracks, can differ from one another distancewise, but can also be the same. That depends essentially on the radius of a switch.

The invention is distinguished, in particular, in that the maximum change in the basic shape of the running rail, transversely of the main or branch track, amounts to 5 mm to 30 mm. By the relevant track widening, in a constructionally simple manner an effect on the wheel- or bogie axle can occur such that the wheel rolling off at the side of the cross frog tip cannot run laterally against the cross frog tip, without the required guidance itself being effected.

Further details, advantages and features of the invention follow not only from the claims, from the features which can be obtained from them—individually and/or in combination —, but also from the following description of the preferred embodiments shown in the drawing.

Figure 2:
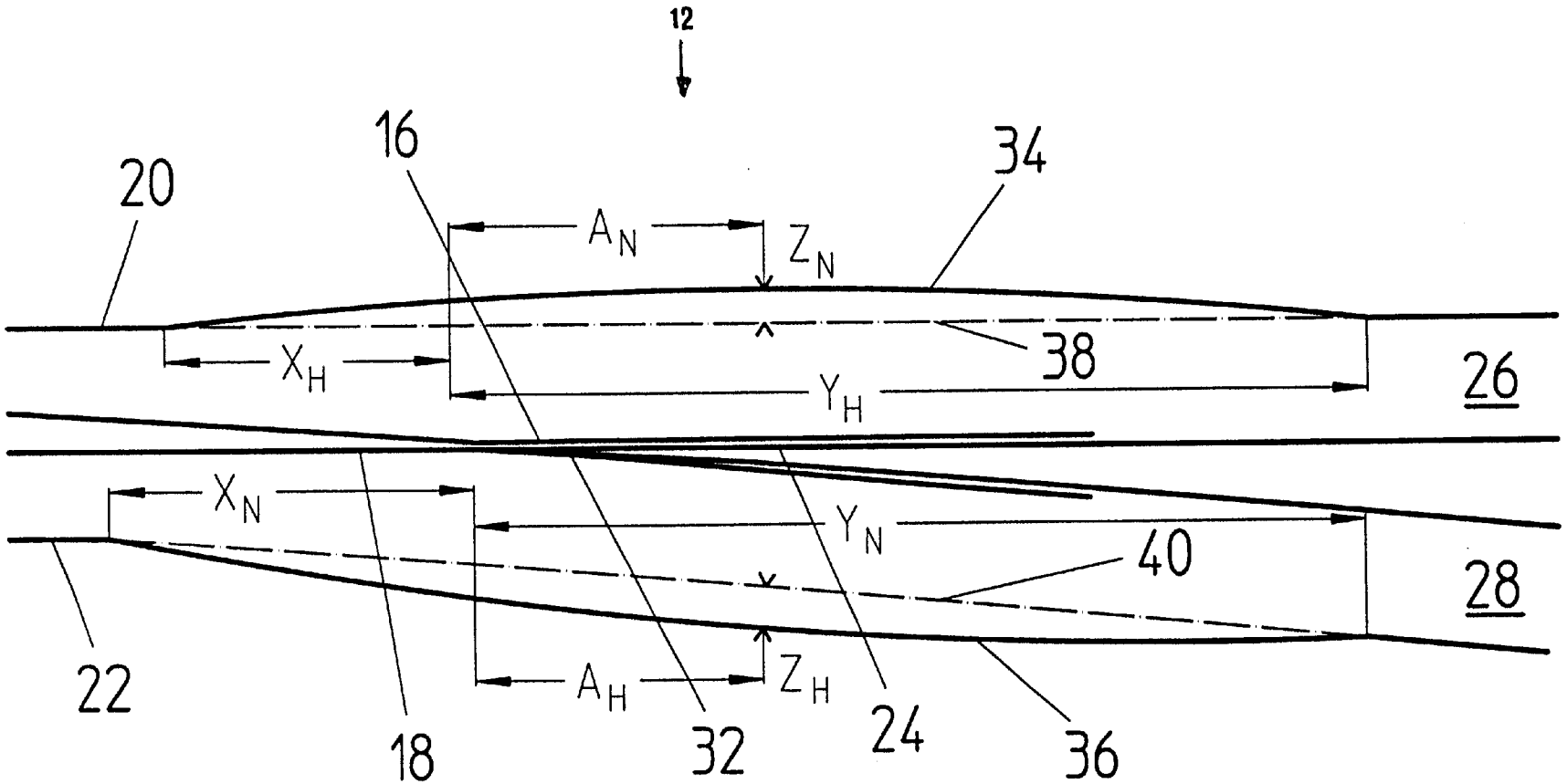
Figure 6:
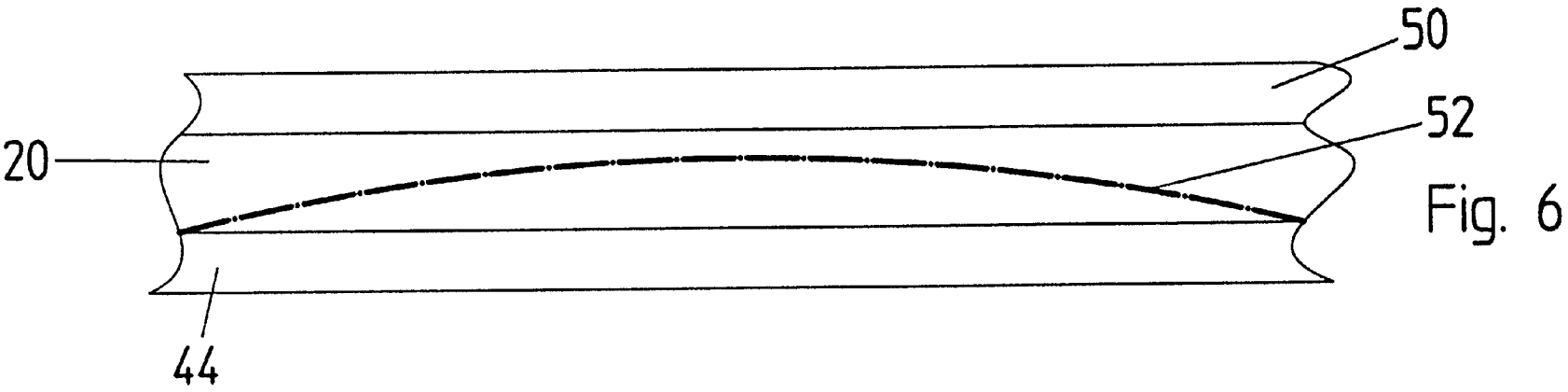
Figure 3:
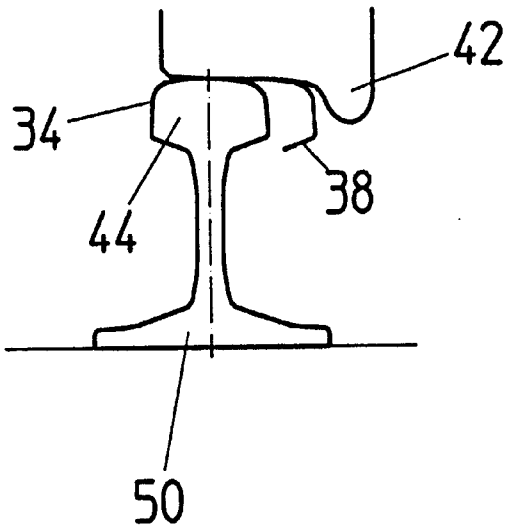
Figure 5:
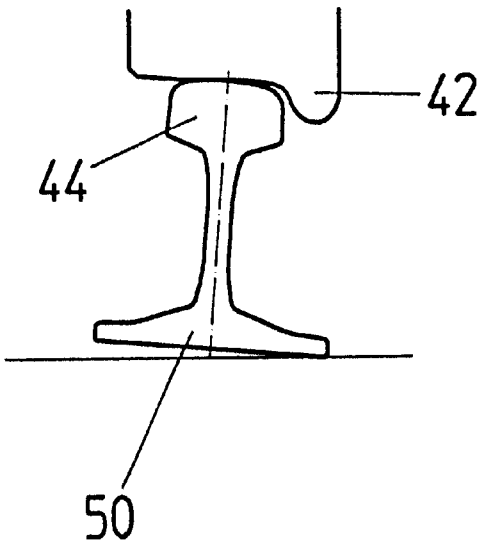
Figure 4:
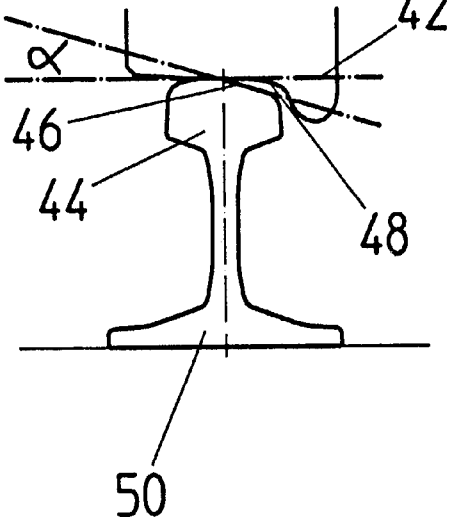

FIG. 1 shows a illustration in principle of a cross frog zone with a rigid cross frog tip, FIG. 2 shows a illustration in principle of a cross frog with a movable cross frog tip, FIG. 3 shows a illustration in principle of a first embodiment for achieving a change of shape of a rail, FIG. 4 shows a illustration in principle of a second embodiment for achieving a change of shape of a rail, FIG. 5 shows a illustration in principle of a third embodiment for achieving a change of shape of a rail and FIG. 6 shows a illustration in principle of a rail in the vicinity of a cross frog tip in plan view.

In FIGS. 1 and 2 there is schematically illustrated a cross frog zone 10 or 12, which according to FIG. 1 has a rigid cross frog tip 14 and, extending to both sides thereof, wing rails 16, 17 and running rails 20, 22. Correspondingly, in FIG. 2, a movable cross frog tip 24 is likewise associated with wing rails 16, 18 and running rails 20, 22. The constructions referred to so far have been known for a long time. Furthermore, in FIGS. 1 and 2, the main track is indicated by reference numeral 26 and the branch track is indicated by reference numeral 28.

In order to ensure, while passing through the cross frog zone 10 or 12, that the cross frog tips 14, 16 are not laterally contacted at their front zone 30 or 32, whereby otherwise an increased wear would occur and, in addition, the travel comfort of a railroad vehicle travelling through the cross frog zone 10, 12 would be negatively influenced, it is provided that the running rail 20 of the main track 26 or the running rail 22 of the branch track 28 undergoes a change of shape such that the respective wheel of the railroad vehicle rolling on the running rails 20, 22 is influenced, at its point of support, in such a way that the corresponding axle of the wheel is oriented with its normal extending relative to the main or branch track 26, 20 in such a way that it extends substantially parallel to the longitudinal axis thereof, so that thereby the wheel rolling on the cross frog tip 14, 24 definitely does not slide, with its flange. along the flank thereof.

In other words, by an intentional change in shape of the running rail 20, 22, which deviates from the basic shape of the running rail 20, 22 outside the cross frog 14, 24, an effect so influences the movement of the wheel- or bogie axle of a railroad vehicle travelling through the cross frog zone 10 that a movement away from the cross frog tip 14, 24 occurs.

In FIGS. 1 and 2, the respective change of shape of the running rails 20, 22 is indicated in principle by reference numerals 34, 36, whereas the basic shape, in broken-line illustration, has reference numerals 38, 40. The shape change 34, 36 here can be achieved in different ways, it being decisive that, in the region of the shape change, the point of support of the wheel is displaced from the cross frog tip 14, 24. In this respect, the full lines 34, 36 represent, in an actual sense, the course of the line of contact between the wheel and the running rail head, i.e. the running surface thereof.

According to the illustration in principle in FIG. 3, the shape change 34, 36 is preferably effected by the running rail 20, 22 extending, in the vicinity of the cross frog 14, 24, curved away therefrom, and thus exhibiting with respect to its running surface, on which the respective wheel is supported, a shape which is concave towards the cross frog tip 14, 24. Thus, there is illustrated in FIG. 3, solely in principle, a wheel 42 rolling on the running rail 20. In the off-set illustration, there is shown a cross-section of the running rail 20 in the zone of the shape change and thus in the zone 34. On the other hand, the running rail 20 with its head 44 is shown, in a broken-line illustration, and indicated by reference numeral 44, outside the shape change and thus in the basic shape 38. By the shape change, which in the embodiment of FIG. 3 is achieved because the running rail 20 has a greater spacing from the cross frog tip 14, 24 in comparison to the normal basic shape, the point of support of the wheel 42 is intentionally altered so that the wheel axle and thus the wheel rolling on the cross frog 14, 24 is virtually "drawn" in the direction of the running rail 20, whereby it is ensured that the flange of the wheel rolling on the cross frog 14, 24 does not grind along the cross frog tip 14, 24.

By the change of shape, there is produced an orientation of the wheel- or bogie axle relative to the main or branch track 26, 20, or the longitudinal axis thereof, such that these extend substantially at a right angle relative to one another, with the consequence that the grinding movement, along the flank of the cross frog tip, of the flange of the wheel rolling on the cross frog tip 14, 24, which is undesired and leads to a premature wear of the cross frog tip 14, 24, does not occur.

A shape change can also be achieved, in accordance with FIG. 4, by the running rail 20, 22 extending, in the zone of the shape change 34, 36, more strongly inclined in its running surface 46 to the cross frog tip 14, 24, by machining of the head 44, than in the basic shape (reference numeral 48), whereby furthermore an alteration of the point of support of the wheel 42 follows since the point of support of the wheel wanders outwardly and thus away from the cross frog tip 14, 24. The running surface of the head 44 in the zone of the shape change 34, 36 thus subtends an angle $\alpha$ to the running surface in the basic shape 38, 40, where $1.5° < \alpha < 5°$.

Alternatively, the running rail 20, 22 can be inclined as a whole in the zone of the shape change, as clearly shown in FIG. 5. In this case, the head 44 of the rail is not altered. Furthermore, the foot 50 thereof is arranged e.g. on a wedge plate, which is not illustrated, in order to set the required inclination of the running surface of the rail head 44 for influencing the point of support of the wheel.

The change of shape of the running rail 20 of the main track 26, in front of the cross frog tip 30, 32, should amount to a distance $X_h$, where 5000 mm$<X_h<$15000 mm, and behind the cross frog tip 30, 32 should amount to a distance $Y_h$, where 8000 mm$<Y_h<$18000 mm. With respect to the shape change 40 in the branch track 28, the distance in front of the cross frog tip 30, 32 should amount to $X_n$, where 5000 mm$<X_n<$20000 mm. and the distance behind the cross frog tip 30, 32 should amount to $Y_n$, where 8000 mm$<Y_n<$23000 mm. p The maximum deviation $Z_h$ or $Z_n$ of the point of support of the wheel in the zone of the shape change 34 or 36, in comparison with the basic shape 38, 40, should amount to 5 mm$<Z_h<$30 mm or 5 mm$<Z_n<$35 mm. In addition, the maximum shape change 34 or 36 should extend at a distance $A_n$ or $A_h$ behind the cross frog tip 14, 24, where 300 mm$<A_n<$2000 or 300 mm$<A_h<$2000 mm.

In as much as the change of shape is achieved by an outwardly curved shape of the running rail 20, 22, the running rail 20, 22 has an bulge of corresponding size $Z_n$ or $Z_h$.

In FIG. 6, again purely in principle, there is shown in a section of the running rail 20 in plan view, a line of contact 52 produced by the points of contact between the running surfaces of the rail head 44 and of the point of support of the wheel 42 being in broken line illustration, which line of contact, in the zone of the cross frog tip 30, 32, extends outwardly curved, and thus concavely, with respect to the cross frog tip 14, 24.

What is claimed is:

1. A cross frog zone (10, 12) for switches and crossings, including a cross frog tip (14, 24) and, extending at both sides thereof, wing rails (16, 18) and running rails (20, 22) having a basic shape (38, 40) aligned with a main or branch track (26, 28), the cross frog zone being traversable by a railroad vehicle having a wheel- or bogie-axle with wheels, wherein at least one of the running rails (20, 22), in a region of the cross frog tip (14, 24), has a shape change (34, 36) deviating from its basic shape (38, 40) in such a way that a wheel traversing the running rail is held to a running circle of radius $r_1$ which is smaller than a running circle of radius $r_2$ to which a wheel rolling on the cross frog tip is held.

2. A cross frog zone according to claim 1, wherein the radii $r_1$ and $r_2$ have a ratio of approximately as $r_1:r_2 \approx 0.91:1$ to $r_1:r_2 \approx 0.98:1$.

3. A cross frog zone according to claim 1, wherein in the region of the cross frog tip (14, 24), the running rail (20, 24) has, with reference to its line of contact (52) formed by the respective point of support of the wheel, a shape which is curved away from the cross frog tip.

4. A cross frog zone according to claim 1, wherein the region of the cross frog tip (14, 24), the running rail (20, 22) is more strongly inclined to the cross frog tip (14, 24), with reference to its running surfaces, in comparison to the running rail in the basic shape (38, 40).

5. A cross frog zone according to claim 1, wherein the running rail (20, 22) at its running surface, in the region where the shape change (34, 36), extends inclined at an angle $\alpha$ a relative to the cross frog tip (14, 24), relative to the running rail in the zone of its basic shape, where $1.5° < \alpha < 5°$.

6. A cross frog zone according to claim 1, shape change (34) of the running rail (20) of the main track (26) begins at a distance $X_h$ in front of the cross frog tip (14, 24), where 5,000 mm$<X_h<$15,000 mm.

7. A cross frog zone according to claim 1, wherein the shape change (34) of the running rail (20) of the branch track (28) begins at a distance $X_n$ in front of the cross-frog tip (14, 24), where 5,000 mm$<X_n<$20,000 mm.

8. A cross frog zone according to claim 1, wherein the shape change (38) of the running rail (20) of the main track (26) terminates at a distance $Y_h$ from the cross frog tip (14, 24), where 8,000 mm$<Y_h<$18,000 mm.

9. A cross frog zone according to claim 1, wherein the shape change (38) of the running rail (20) of the branch track (28) terminates at a distance $Y_n$ from the cross frog tip (14, 24), where 8000 mm$<Y_n<$23,000 mm.

10. A cross frog zone according to claim 1, wherein the maximum basic shape change of the running rail (20) of the main track (26), transverse to the main track, amounts to $Z_n$, where 5 mm$<Z_n<$30 mm.

11. A cross frog zone according to claim 1, wherein the maximum basic shape change of the running rail (20) of the branch track (28), transverse to the branch track, amounts to $Z_h$, where 5 mm$<Z_h<$30 mm.

12. A cross frog zone according to claim 10, wherein the maximum basic shape change $Z_h$ of the running rail (20) of the main track (26) extends in a distance $A_n$ behind the cross frog tip (30, 32), where 300 mm$<A_n<$2000 mm.

13. A cross frog zone according to claim 11, wherein the maximum basic shape change $Z_n$ of the running rail (20) of the branch track (28) extends in a distance $A_h$ behind the cross frog tip (30, 32), where 300 mm$<A_h<$2000 mm.

* * * * *